US008261957B2

(12) United States Patent
Yagi

(10) Patent No.: US 8,261,957 B2
(45) Date of Patent: Sep. 11, 2012

(54) LOCKING MECHANISM FOR STAPLER PAPER PRESSER TABLE

(75) Inventor: Nobuaki Yagi, Tokyo (JP)

(73) Assignee: Max Co., Ltd., Tokyo (JP)

( * ) Notice: Subject to any disclaimer, the term of this patent is extended or adjusted under 35 U.S.C. 154(b) by 1184 days.

(21) Appl. No.: 10/567,860

(22) PCT Filed: Aug. 10, 2004

(86) PCT No.: PCT/JP2004/011739

§ 371 (c)(1),
(2), (4) Date: Feb. 10, 2006

(87) PCT Pub. No.: WO2005/014237

PCT Pub. Date: Feb. 17, 2005

(65) Prior Publication Data

US 2006/0213951 A1 Sep. 28, 2006

(30) Foreign Application Priority Data

Aug. 11, 2003 (JP) ..... P.2003-291269

(51) Int. Cl.
*B25C 5/02* (2006.01)
*B25C 5/15* (2006.01)

(52) U.S. Cl. ..... 227/155; 227/8; 227/140

(58) Field of Classification Search ..... 227/8, 131, 227/155

See application file for complete search history.

(56) References Cited

U.S. PATENT DOCUMENTS

| | | | | |
|---|---|---|---|---|
| 3,056,965 | A * | 10/1962 | Rogers | 227/8 |
| 4,629,106 | A * | 12/1986 | Howard et al. | 227/8 |
| 5,791,543 | A * | 8/1998 | Udagawa et al. | 227/4 |
| 5,791,544 | A * | 8/1998 | Fujimaki | 227/7 |
| 5,806,750 | A | 9/1998 | Yamanushi et al. | 227/155 |
| 6,036,074 | A * | 3/2000 | Manabe | 227/155 |
| 6,050,471 | A * | 4/2000 | Yagi | 227/119 |
| 6,626,348 | B2 * | 9/2003 | Kitamura | 227/155 |
| 6,698,640 | B2 * | 3/2004 | Hakozaki et al. | 227/4 |
| 6,719,181 | B2 * | 4/2004 | Kanai et al. | 227/2 |
| 6,820,790 | B2 * | 11/2004 | Ura | 227/131 |
| 6,981,627 | B2 * | 1/2006 | Tsai | 227/155 |
| 7,014,084 | B2 * | 3/2006 | Mochizuki et al. | 227/1 |
| 7,124,925 | B2 * | 10/2006 | Ishizaki | 227/155 |
| 7,143,921 | B2 * | 12/2006 | Hakozaki et al. | 227/120 |

FOREIGN PATENT DOCUMENTS

| | | |
|---|---|---|
| JP | UM-1986-166774 | 10/1986 |
| JP | A-7-148673 | 6/1995 |
| JP | A-7-506057 | 7/1995 |
| JP | A-7-266253 | 10/1995 |
| JP | B2-2688114 | 10/1997 |
| JP | 2002-066951 | 3/2002 |

* cited by examiner

*Primary Examiner* — Lindsay Low

(74) *Attorney, Agent, or Firm* — Morgan, Lewis & Bockius LLP

(57) ABSTRACT

Immediately after a clinch lever causes a clinch link to clinch the leg of a staple which penetrates sheets of paper to be stapled, a pressure by the clinch lever with respect to the clincher link is temporarily reduced by a pressure reducing unit. Therefore, a clincher moves down in a state where the clincher still receives the press-contacting force from a driver plate. Accordingly, the looseness occurs between the driver plate and the clincher link. A fixing plate becomes easy to draw out as much as the looseness. If the fixing plate is set to be drawn out at this timing, it can be simply drawn out to be moved to the initial position.

3 Claims, 14 Drawing Sheets

LOCKING MECHANISM FOR STAPLER PAPER PRESSER TABLE

TECHNICAL FIELD

The present invention relates to a paper-pressing table lock mechanism of stapler for fixing a table, on which sheets of paper to be stapled is set, in a paper-pressing state and releasing the fixing immediately after clinching each leg of a staple penetrating the sheets of paper.

BACKGROUND ART

In order to staple sheets of paper, a general stapler strongly presses and clamps the sheets of paper between a stapling table and a unit for driving a staple. After this state is fixed, a staple is driven so as to penetrate the sheets of paper, and each leg of the staple is then clinched by a clincher.

Such a lock mechanism has been disclosed in JP-B2-2688114, for example.

As shown in FIG. 4 of JP-B2-2688114, a fixing pin 39 is engaged with a bow-shaped slot 38 of a fixing plate 36 and the diameter of curvature of the slot 38 increases, thereby causing a wedge action between the wall of the slot 38 and the fixing pin 39. Such a wedge action fixes a stapler head 12 in an operation position so as not to be vibrated up and down by a rotation of a rotating pin 13.

However, since a frictional resistance between a wall of the slot 38 and the fixing pin 39 is significantly large when the wedge action occurs between them, plenty of energy is needed to rotate the fixing plate 36 in the original position after the fixing. Therefore, when the fixing plate 36 is rotated by a force of a spring, a strong spring is needed, and when the fixing plate 36 is rotated by electricity, much electric power is needed.

DISCLOSURE OF THE INVENTION

In order to solve the above-mentioned problems, it is an object of the present invention to provide a paper-pressing table lock mechanism of a stapler which can easily draw out a fixing plate by temporarily reducing a force for clinching a staple immediately after each leg of the staple is clinched.

In order to attain the object, a paper-pressing table lock mechanism of a stapler of the present invention is provided with a table link that is rotatably provided in a base and has a paper-pressing table including a movable clincher on the leading end thereof, the table link having a fixing pin projecting on the side surface thereof; a fixing plate that is provided so as to slide with a wedge action with respect to the fixing pin and that is engaged with the fixing pin to lock the table link in a paper-pressing state; a driver that holds sheets of paper to be stapled, which is pressed against the table, and push up a staple from the opposite side toward the table; a clincher link that is rotatably provided in the base so as to press the movable clincher of the table link in the paper-pressing state from the opposite side to the driver and that clinches each leg of the staple penetrating the sheets of paper to be stapled; a clinch lever that presses the clincher link to operate; and a pressure reducing mechanism that temporarily reduces the pressure by the clinch lever with respect to the clincher link.

It is preferable that the pressure reducing mechanism is a sector-shaped cam of which the periphery is engaged with the clinch lever, and a stepped portion with respect to the clinch lever is formed on the periphery of the sector-shaped cam.

When the clinch lever is engaged with the stepped portion, the pressure with respect to the clincher link may be reduced.

Figure 1:
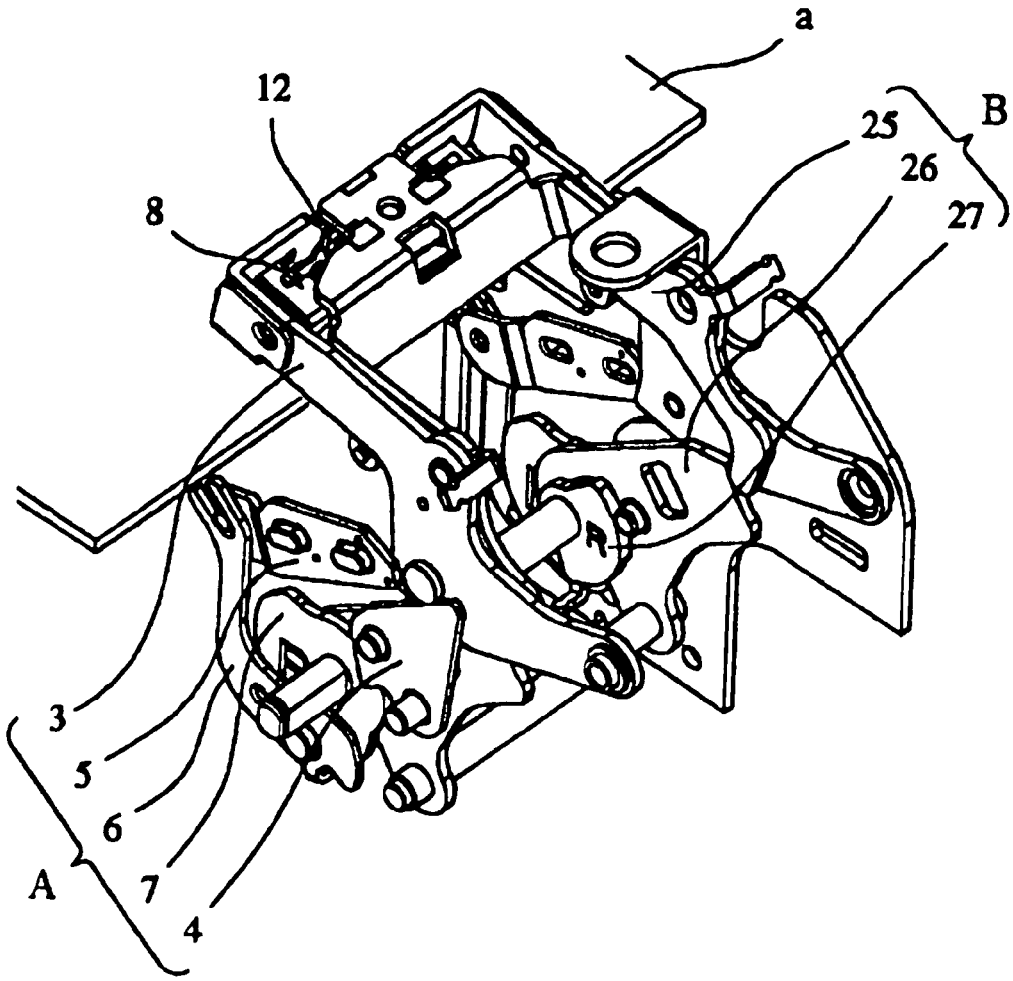
FIG. 1 is a perspective view schematically illustrating a table lock mechanism and a clincher mechanism.
Figure 2:
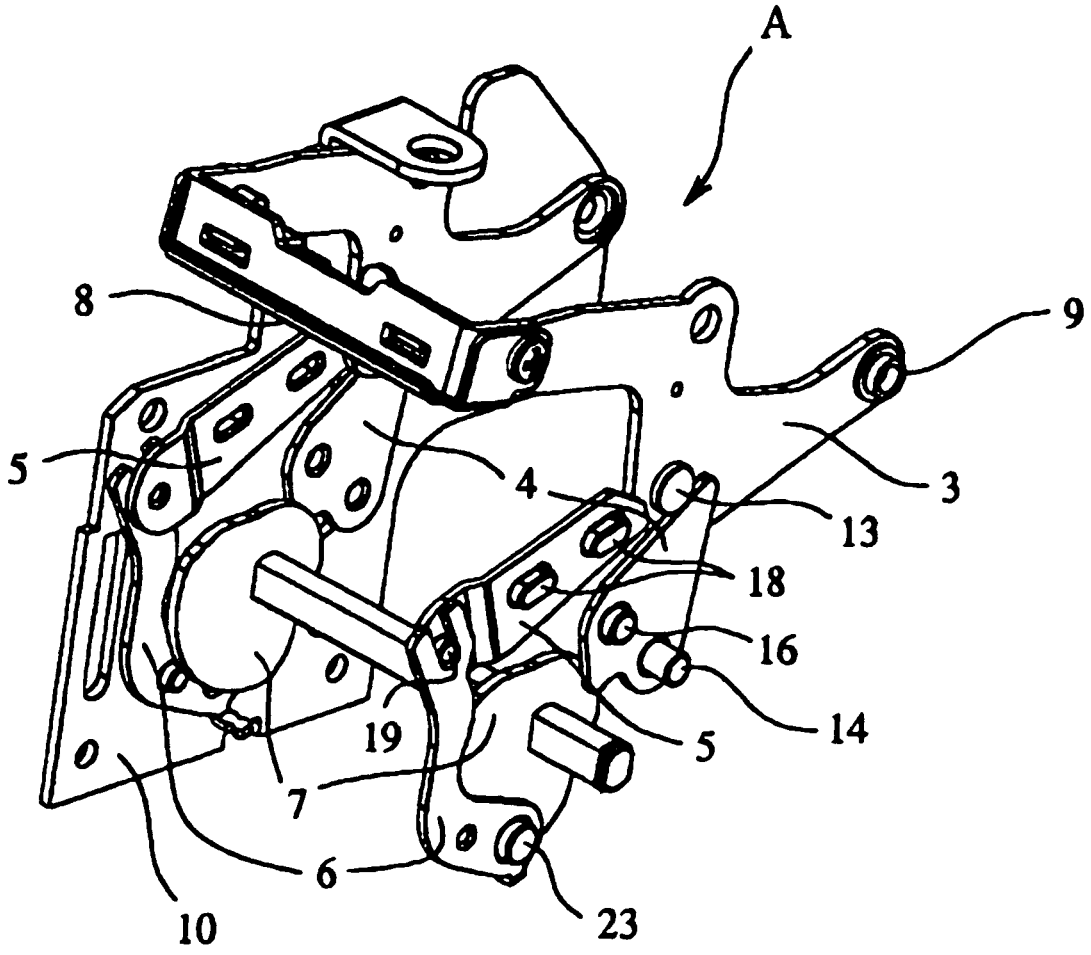
FIG. 2 is a perspective view of the table lock mechanism.
Figure 3:
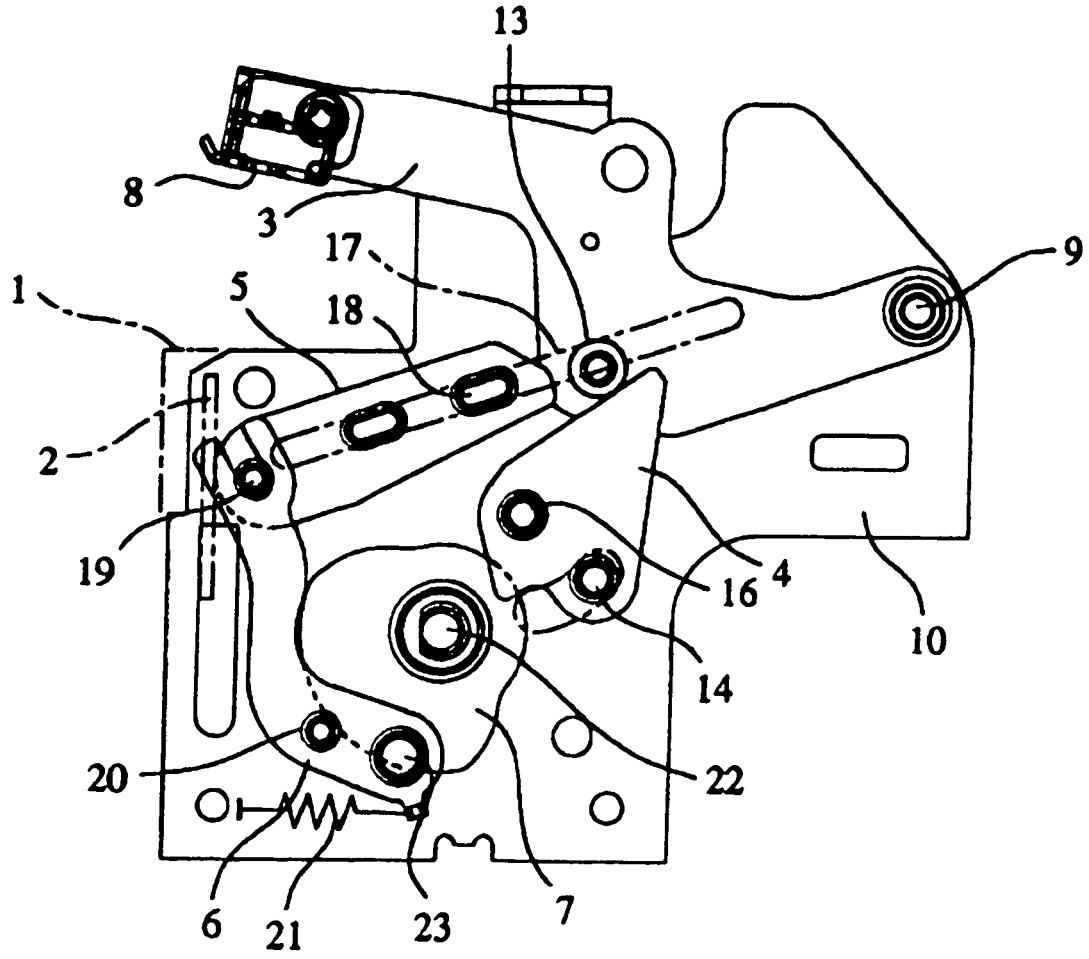
FIG. 3 is a diagram illustrating the side of the table lock mechanism before operation.

In the drawings, reference numeral 3 represents a table link, reference numeral 5 represents a fixing plate, reference numeral 8 represents a table, reference numeral 13 represents a fixing pin, reference numeral 25 represents a clincher link, reference numeral 26 represents a clinch lever, reference numeral 27 represents a clinch cam, reference numeral 34 represents a circular arc section, and reference numeral 35 represents a stepped portion.

BEST MODE FOR CARRYING OUT THE INVENTION

FIG. 1 is a perspective view of an embodiment of the present invention, illustrating a table lock mechanism A and clinch mechanism B of an electric stapler. The table lock mechanism A, which presses a table 8 against sheets of paper (a) to be stabled when the sheets of paper (a) to be stapled is set in a predetermined position, is composed of a table link 3, a return link 4, a fixing plate 5, a table fixing link 6, and a fixing cam 7. On the other hand, the clinch mechanism B, which pushes up a staple into the sheets of paper (a) in a state where the sheets of paper is pressed (hereinafter, referred to as 'the paper-pressing state'), and clinches each leg of the staple which has penetrated the sheets of paper (a) by the pushing up, is composed of a clincher link 25, a clinch lever 26, and a clinch cam 27.

Next, the table lock mechanism will be described sequentially with reference to FIGS. 2 to 5. Reference numeral 10 denotes abase plate in which both mechanisms are provided. Two sheets of base plates are provided parallel to each other. Further, a stapling table 1 is fixed to the upper portion of the front portion of the base plate 10. A driver 2, provided to move along a substantially straight line from the lower side of the stapling table 1 toward the upper side, is driven to push up a staple on the sheets of paper (a) pressed against the table 8. The table lock mechanism, clinch mechanism, and driver driving mechanism are operated by the same motor. In addition, the staples are sequentially supplied to the table 8 in a state where each leg thereof is upward.

The table link 3 is substantially Z-shaped. On the front end thereof, the table 8 is provided, and the back end thereof is rotatably supported by receiving a projecting shaft 9 into a bearing provided on the rear upper portion of the base plate 10. The table 8 has a movable clincher 12 (refer to FIG. 1) which presses the upper portion of the sheets of paper (a) set on the stapling table 1 and clinches each leg of the staple penetrating the sheets of paper (a). In addition, on the side of the table link 3, a fixing pin 13 is formed, protruding beyond the table link. The table link 3 and a clincher link to be described below are biased together by a spring (not shown) so as to rotate downward.

The return link 4, which moves the downward-rotating table link 3 upward, is disposed so as to be engaged with the fixing pin 13. A side pin 14 of the return link 4 is engaged with a circular arc groove 15 formed on the base plate 10 by a cam (not shown). The return link 4 can reciprocate in the range where the pin 14 moves within the circular arc groove 15, centered on a projecting shaft 16 supported by the base plate 10.

The fixing plate 5 has a convex portion 18 which is engaged with a guide groove 17 formed on the base plate 10. The lower surface of the fixing plate 5 is formed obliquely so that the front portion thereof is more separated with respect to the guide groove 17 than the back portion thereof. Such a structure allows the fixing plate 5 to slide in a wedge shape with respect to the fixing pin 13. In addition, on the front end of the fixing plate 5, a pin 19 is formed.

The table fixing link 6 has the middle portion formed to be bent. On the upper end of the table fixing link 6, a split groove is formed to be engaged with the pin 19 of the fixing plate 5. In the vicinity of the lower end of the table fixing link 6, a pin 20 is provided, and the lower end is provided so as to rotate about a protruding shaft 23 provided on the base plate 10. In the lower end of the projecting shaft 23, a spring 21 is mounted to bias the fixing plate 5 so that the fixing plate 5 always rotates in the clockwise direction of FIG. 3.

The fixing cam 7 is integrally fixed to a driving shaft 22 for driving the driver 2 and is engaged with the pin 20 of the table fixing link 6.

Figure 4:
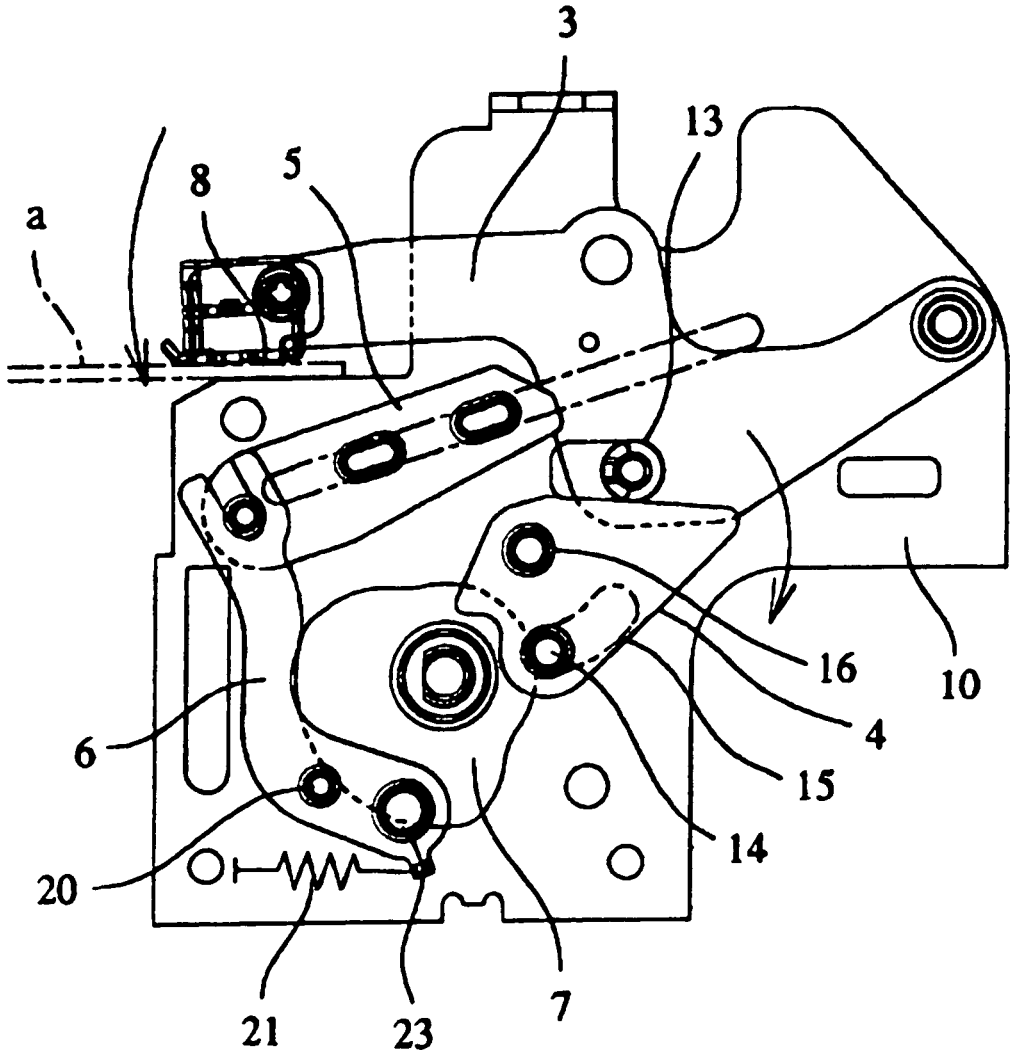
FIG. 4 is a diagram illustrating the side of the table lock mechanism when papers are pressed.
Figure 5:
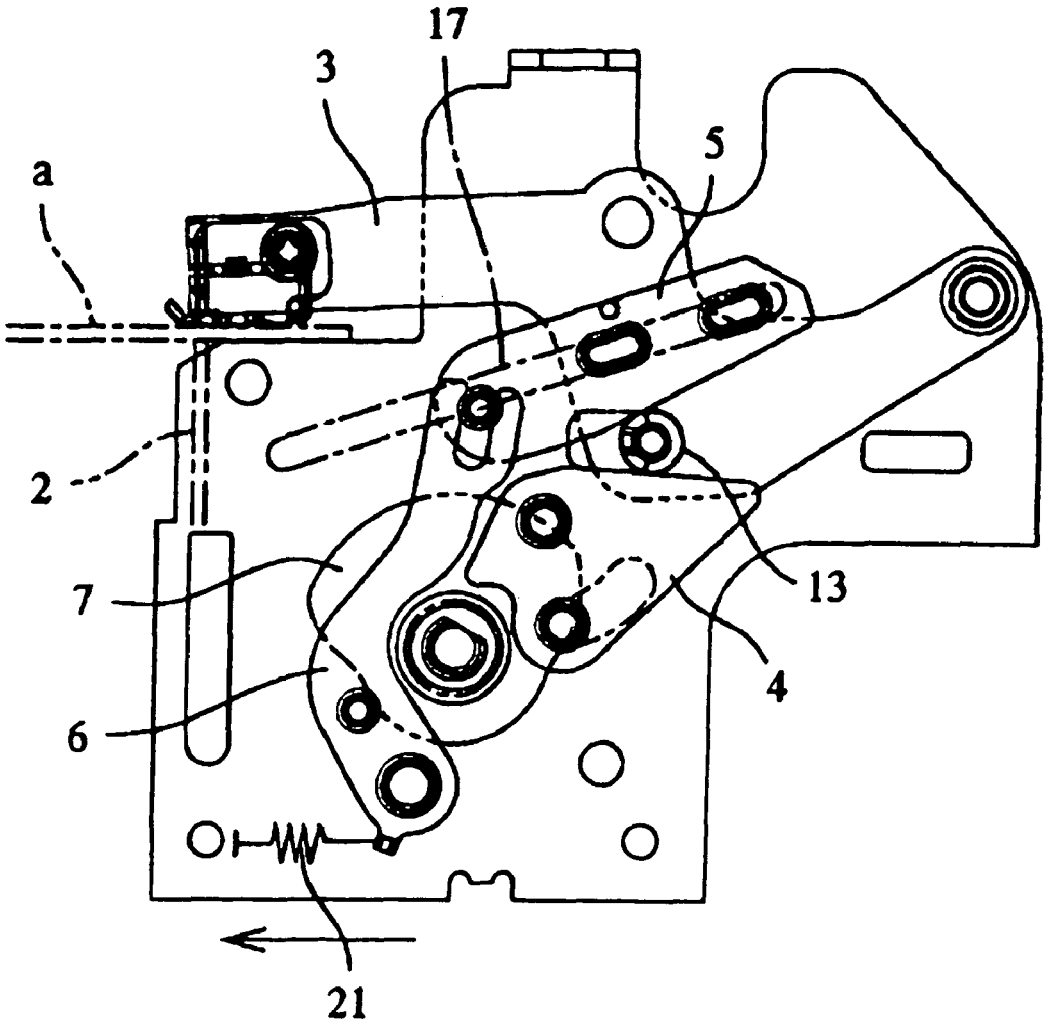
FIG. 5 is a diagram illustrating the side of the table lock mechanism at the time of table-locking.

According to the table lock mechanism, if the sheets of paper to be stapled (a) is set on the stapling table 1 and the motor of the electric stapler is activated, the table link 3 rotates in the counterclockwise direction to move downward as shown in FIG. 4, and the table 8 thereof strongly presses the sheets of paper (a). Further, the return link 4 rotates in the clockwise direction to allow the rotation of the table link 3. In addition, as shown in FIG. 5, the cam 7 also rotates, however, at this time, the pin 20 of the table fixing link 6 is engaged with the periphery, which is close to the center of the fixing cam 7 Therefore, since the table fixing link 6 is rotated in the clockwise direction by a spring force, the fixing plate 5 slides in a wedge shape along the guide groove 17, and the lower surface thereof is engaged with the upper portion of the fixing pin 13 of the table link 3. Accordingly, the table link 3 is locked so as not to move upward. As a result, the table link 3 is locked in a state where the table 8 strongly presses the sheets of paper to be stapled (a).

Figure 6:
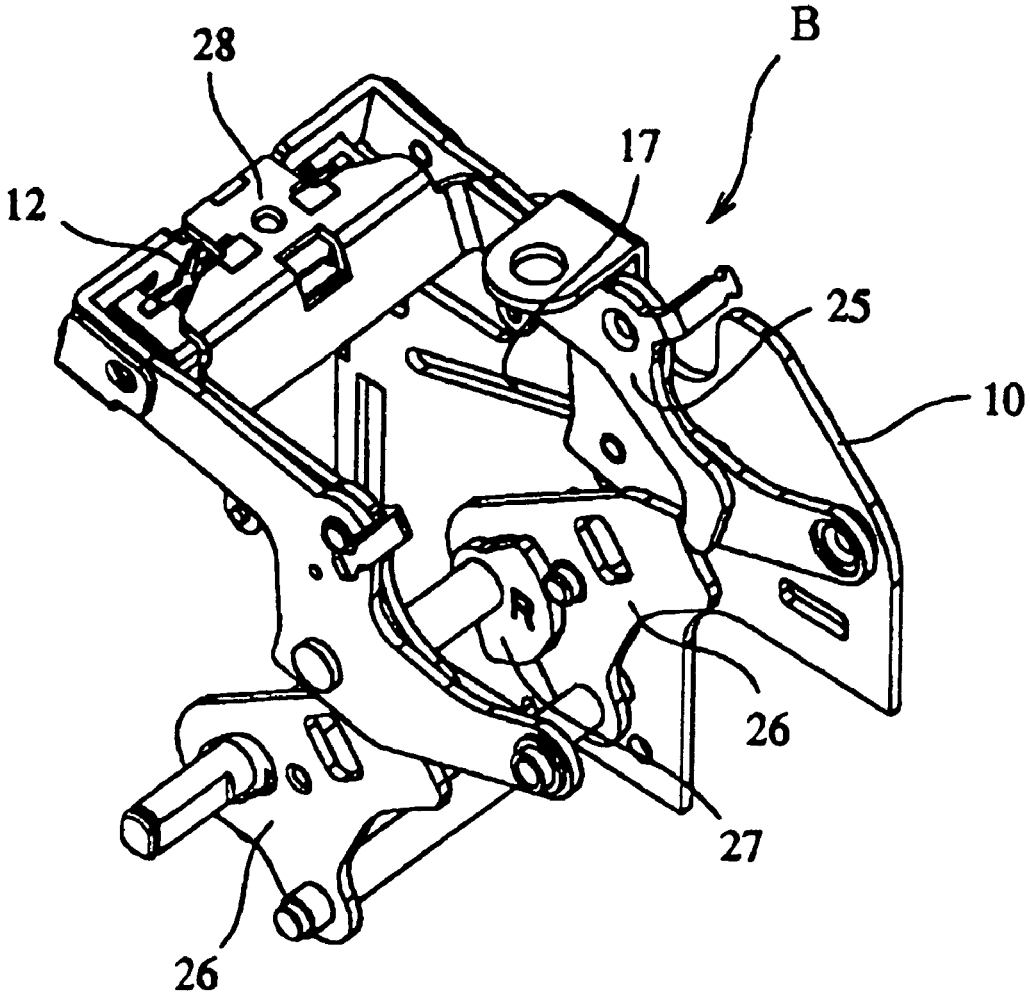
FIG. 6 is a perspective view of the clincher mechanism.
Figure 7:
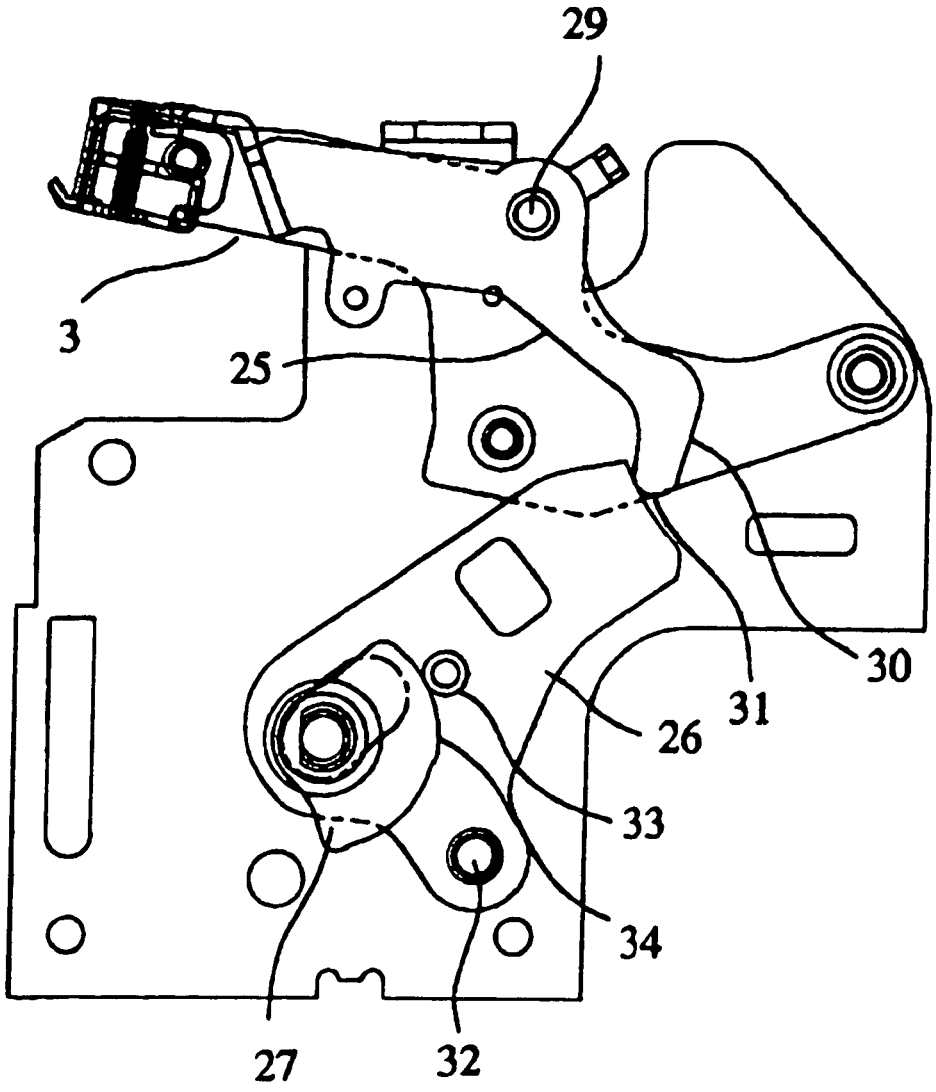
FIG. 7 is a diagram illustrating the side of the clincher mechanism before operation.

FIGS. 6 and 7 are a perspective view and a diagram showing the clinch mechanism, which is composed of the clincher link 25, the clinch lever 26, and the clinch cam 27, as described above.

The clincher link 25 has a clincher pressing section 28 in the front end thereof. Its middle portion is supported to freely rotate in clockwise and counterclockwise direction about a shaft 29 provided in the middle portion of the table link 3, and the rear portion is formed as a leg 30 which is bent in an obtuse angle. On the rear end of the leg 30, an engagement portion 31 is formed to be substantially downward. When the clincher link 25 rotates in the counterclockwise direction of the drawing, the clincher pressing section 28 presses the movable clincher of the table link 3 to operate. Since the shaft 29 moves up and down as the table link 3 rotates, the whole clincher link 25 also moves up and down together with the shaft.

The clinch lever 26 is provided to rotate in clockwise and counterclockwise direction about a support shaft 32 provided in the lower portion of the base plate 10. The leading end of the clinch lever is formed in a substantially circular arc shape and is disposed so as to be engaged with the engagement portion 31 of the clinch link 25. In addition, an engagement pin 33 is formed at the substantial center of the clinch lever 26, protruding beyond it.

The clinch cam 27 is a sector-shaped cam, that is, of which the overall feature has a sector shape. The right and left pair of base portions of the clinch cam 27 are fixed to a driving shaft which is linked to a motor. Further, a circular arc portion 34 that defines periphery is engaged with the engagement pin 33 of the clinch lever 26.

Figure 8:
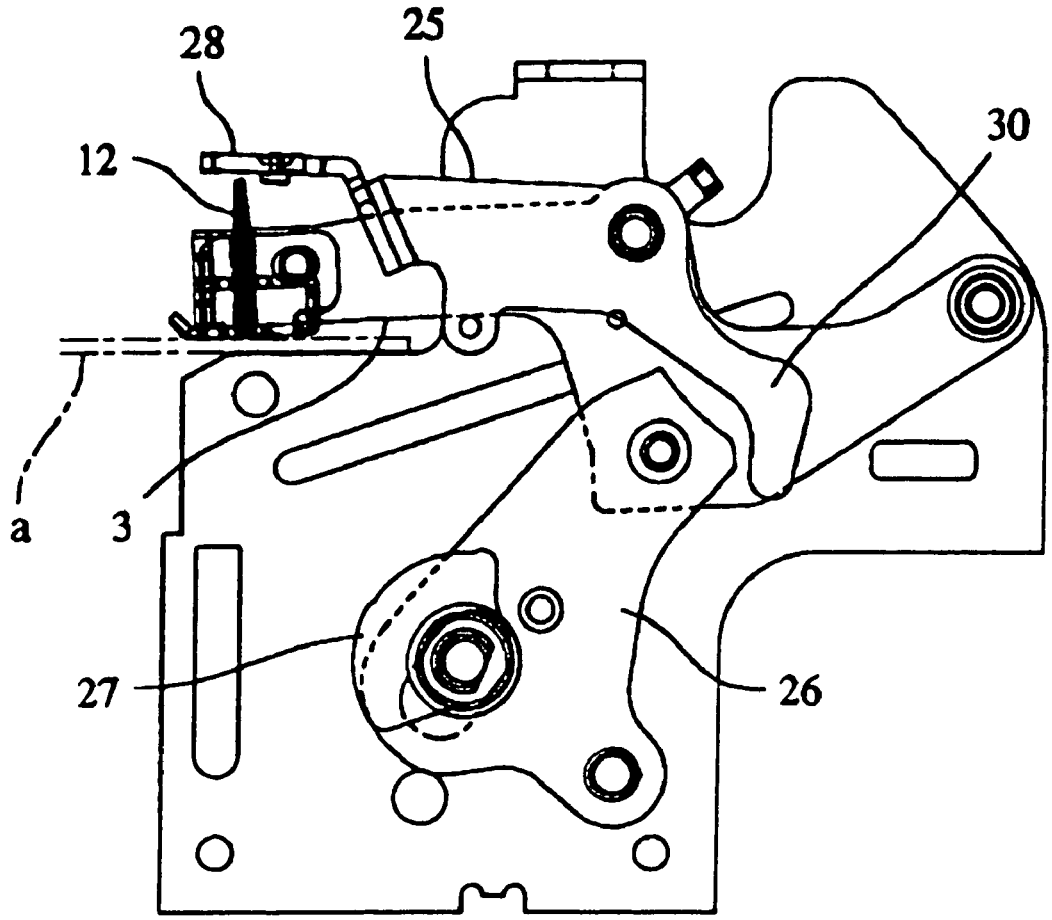
FIG. 8 is a diagram illustrating the side of the clincher mechanism before clinching.
Figure 9:
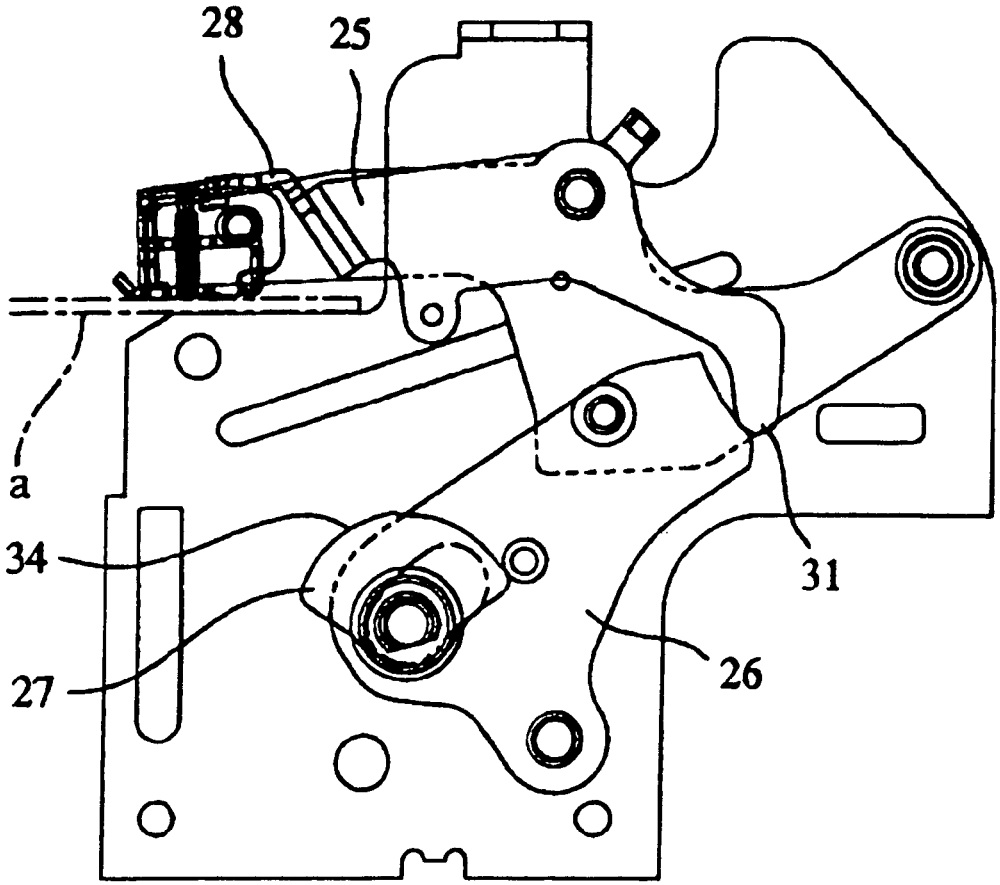
FIG. 9 is a diagram illustrating the side of the table lock mechanism at the time of clinching.
Figure 11:
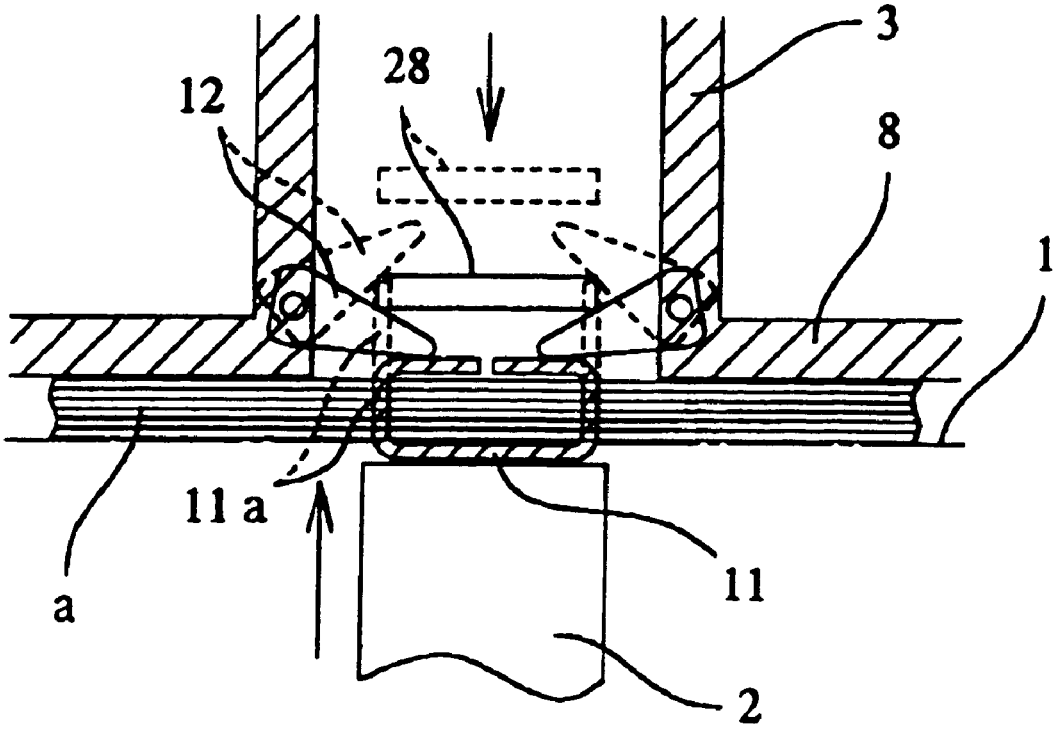
FIG. 11 is a diagram explaining an operation of the clincher mechanism.

According to the clinch mechanism, when the table link 3 rotates downward to press the sheets of paper a as described above, the clincher link 25 does not simultaneously rotate, keeping its position. At this time, the leg 30 of the clincher link 25 becomes free from the clinch cam 27 in a state where it is disengaged from the clinch lever 26, as shown in FIG. 8. Next, in the above-described paper-pressing state, the driver 2 for pushing up a staple is driven from the lower side, a staple 11 is pushed up from the stapling table 1 toward the sheets of paper (a), and each leg 11*a* of the staple 11 penetrates the sheets of paper (a) so as to protruding beyond the rear side of the paper, as shown in FIG. 11. After that, in order for the circular arc portion 34 of the rotated clinch cam 27 to push the engagement pin 33 of the clinch lever 26 as shown in FIG. 9, the clinch lever 26 rotates in the clockwise direction, and its leading end is engaged with the engagement portion 31 of the clincher link 25 so as to press the engagement portion 31. Therefore, the clincher link 25 rotates in the counterclockwise direction, and its pressing section 28 presses the movable clincher 12 of the table link 3 so as to operate, which has been in the paper-pressing state. Then, as shown in FIG. 11, each leg 11*a* of the staple 11, which has penetrated the sheets of paper (a), is clinched, and the stapling operation is completed. Therefore, the fixing plate 5 which has been in the state of FIG. 5 is drawn by the fixing cam 7 so as to move to the initial position, and the table link 3 also returns to the initial position.

As shown in FIG. 11, however, the clearance between the leading end of the driver 2 and the table 8 of the table link 3 becomes larger as much as the thickness of the leg 11*a* when the movable clincher 12 operates to clinch the leg 11*a* than when the driver 2 is driven, in order that the leg 11*a* of the staple penetrates the paper, and a press-contacting force of the fixing pin 13 with respect to the fixing plate 5 increases. Therefore, a strong force is needed to draw out the fixing plate 5 in this state. Accordingly, if the press-contacting force of the clincher 12 with respect to the driver 2 is temporarily reduced (may be released) by escaping the movable clincher 12 in a state where the movable clincher 12 still receives the press-contacting force from the driver 2, the force which pushes up the driver 2 is relaxed so that the looseness between the driver 2 and the clincher link 25 occurs. An amount of tightening with respect to the staple 11 is reduced as much as the looseness, and the fixing plate 5 is easy drawn out.

Subsequently, as a pressure reducing mechanism which temporarily reduces the pressure by the clinch lever 26 with respect to the clincher link 25, a pressure reducing unit is provided. The pressure reducing unit is constructed with an stepped portion (concave section) 35 with respect to the engagement pin 33 of the clinch lever 26, which is formed on the circular arc section 34 of the clinch cam 27. The stepped portion 35 is formed in a portion slightly shifted from the end of the circular arc section 34. When the engagement pin 33 of the clinch lever 26 is engaged with the stepped portion, the pressure of the clinch lever 26 with respect to the clincher link 25 is reduced. At this timing, the fixing plate 5 is set to be drawn out.

Figure 10:
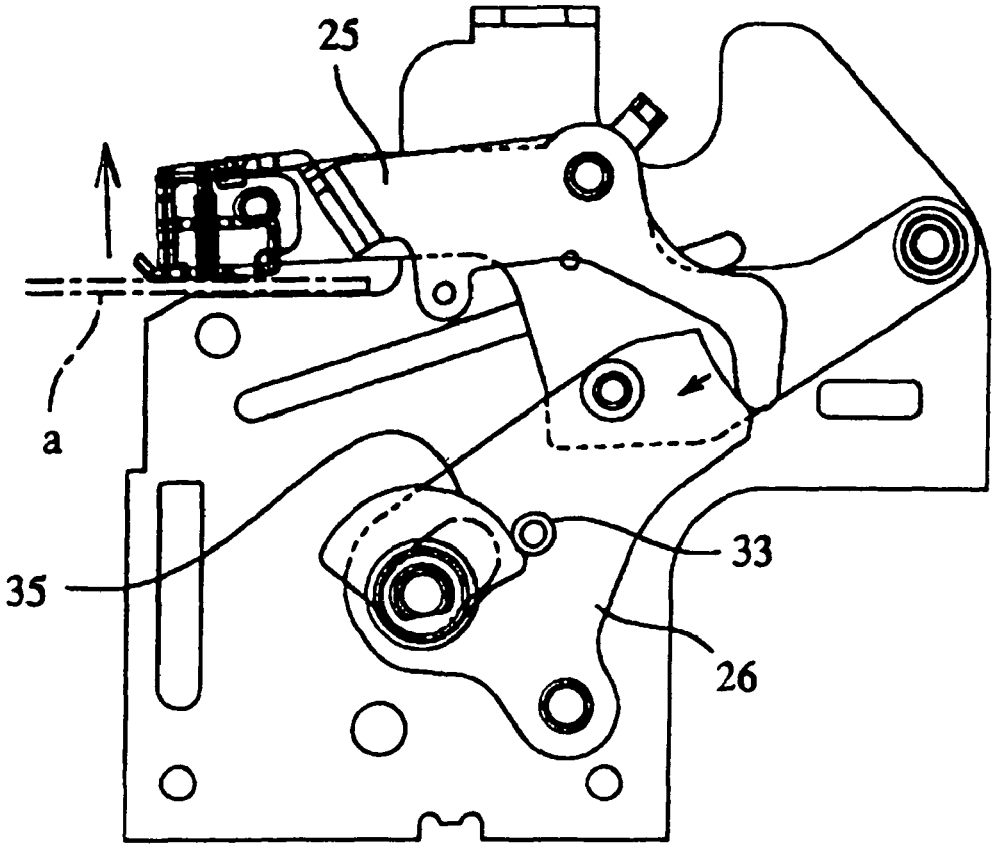
FIG. 10 is a diagram explaining a state where the looseness occurs in a clincher link.
Figure 12A:
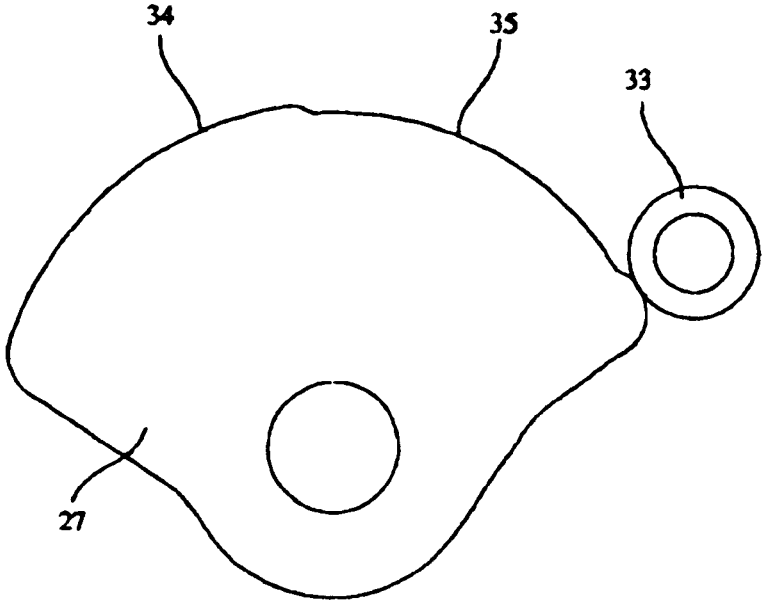
FIG. 12A is a diagram explaining the positional relationship between a clinch cam and an engagement pin at the time of clinching.
Figure 12B:
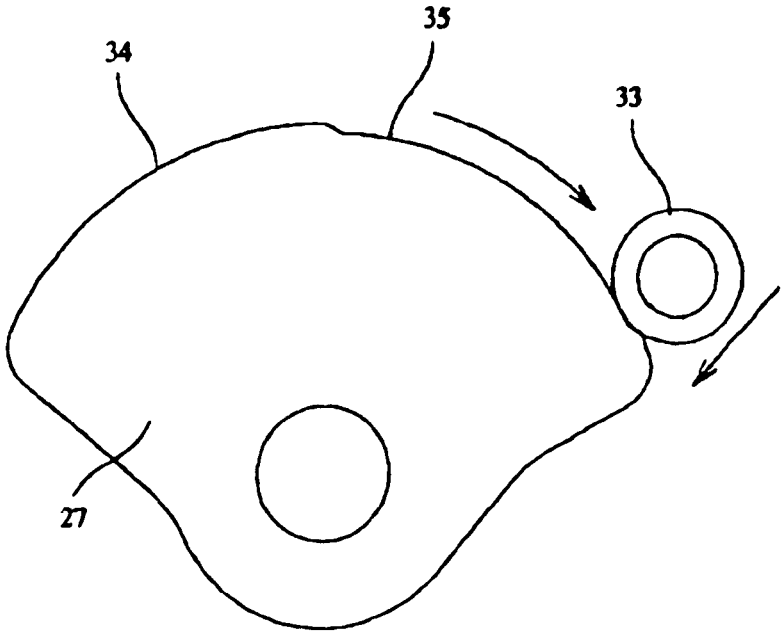
FIG. 12B is a diagram explaining the positional relationship when the pressure is reduced.

In this structure, if the clinch cam 27 rotates so that the engagement pin 33 moves to the position corresponding to the concave section 35 as shown in FIG. 12B immediately after the engagement pin 33 of the clinch lever 26 is pushed out by the end portion of the circular arc section 34 so as to clinch the leg of the staple as shown in FIG. 12A, the engagement pin 33 of the clinch lever 26 sinks into the concave section 35. Therefore, as shown in FIG. 10, the press-contacting force of the clinch lever 26 with respect to the clincher link 25 is reduced in the direction of an arrow. Therefore, by pushing up the movable clincher 12 in order for the force against the driver 2 is reduced, the looseness between the driver 2 and the clinch link 25 occurs. Since the amount of tightening with respect to the staple is reduced as much as the looseness, the fixing plate 5 can be simply drawn out to be moved to the initial position.

Figure 13:
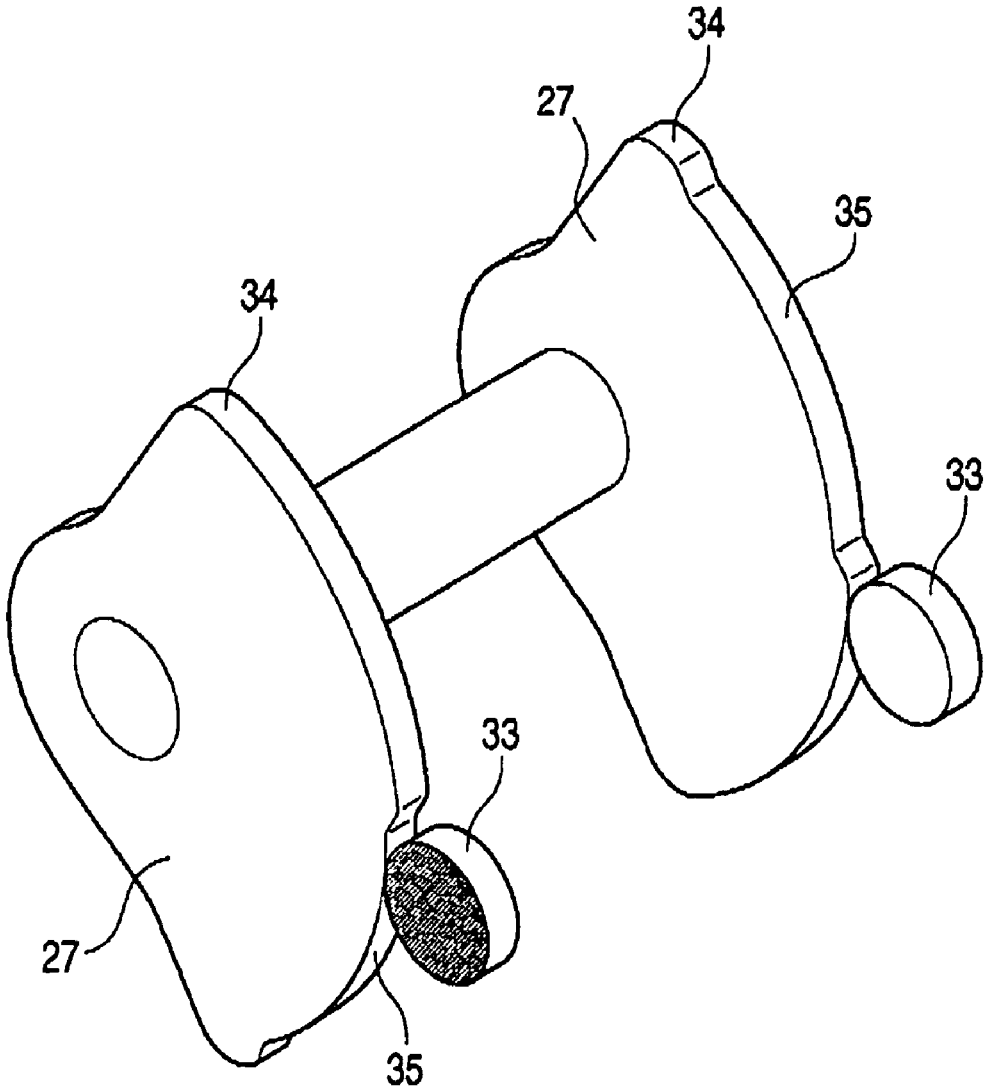
FIG. 13 is a diagram explaining the positional relationship between the left and right clinch cam when the phase between the concave sections 35 are shifted.
Figure 14:
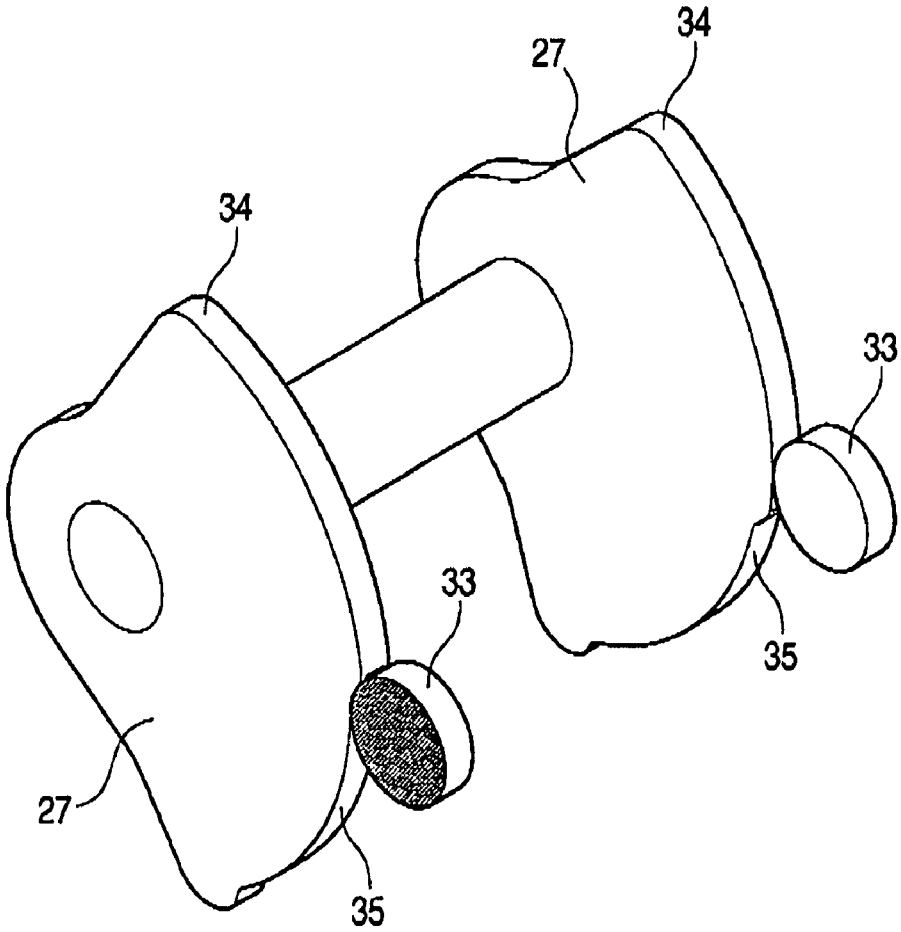
FIG. 14 is a diagram explaining the positional relationship between the left and right clinch cam when the phase difference is about 15°.

In the above-described pressure reducing unit, the left and right clinch cams 27 are formed in the same external feature and are mounted on a driving shaft so as to rotate in the same phase. However, the external feature of the right clinch cam 27 and the external feature of the left clinch cam 27 may be formed to be different from each other so that the phase between the concave sections 35 of the right and left clinch cams 27 is shifted as shown in FIG. 13. In addition, the left and right clinch cams 27 may be mounted on a driving shaft so that the phase difference between the left and right clinch cams 27 occurs (for example, about 15°). See FIG. 14. In this case, the engagement pin 33 of the clinch lever 26 sinks into the respective concave sections 35 with the time difference between the left and right (the timing between the left and right is shifted). Therefore, the reduction in the press-contacting force with respect to the clincher link 25 is performed separately in the left and right.

In addition, the pressure reducing unit is not limited to the unit using a sector-shaped cam. For example, the rotation shaft of the sector-shaped cam itself may be moved in the stepped direction.

INDUSTRIAL APPLICABILITY

In the paper-pressing table lock mechanism of a stapler according to the present invention, immediately after the clinch lever causes the clinch link to clinch the leg of the staple which penetrates the sheets of paper to be stapled, the pressure by the clinch lever with respect to the clincher link is temporarily reduced by the pressure reducing unit. Therefore, the clincher moves down in a state where the clincher still receives the press-contacting force from the driver plate. Accordingly, the looseness occurs between the driver plate and the clincher link. The fixing plate becomes easy to draw out as much as the looseness. If the fixing plate is set to be drawn out at this timing, it can be simply drawn out to be moved to the initial position.

In addition, when the clinch lever is engaged with the stepped portion of the sector-shaped cam, the pressure with respect to the clincher link can be reduced. Therefore, the fixing plate can be easily drawn out by a simple structure.

The invention claimed is:

1. A paper-pressing table lock mechanism of a stapler comprising:

a table link rotatably provided in a base;

a paper-pressing table provided on the table link;

a movable clincher provided on a leading end of the paper-pressing table;

a fixing pin projecting on a side surface of the table link;

a fixing plate linearly slidable with respect to the fixing pin and engagable with the fixing pin to lock the table link in a paper-pressing state;

a driver that drives a staple to sheets of paper to be stapled pressed against the paper-pressing table;

a clincher link that is rotatably provided in the base so as to press the movable clincher of the table link in the paper-pressing state from an opposite side of the driver and that clinches each leg of the staple penetrating the sheets of paper to be stapled;

a clinch lever that presses the clincher link; and a pressure reducing mechanism that temporarily reduces the pressure by the clinch lever with respect to the clincher link;

wherein the table link and the fixing plate are separate members, and the table link and the fixing plate are relatively movable to each other.

2. The paper-pressing table lock mechanism of a stapler according to claim 1, wherein the pressure reducing mechanism comprises a sector-shaped cam, and a periphery of the sector-shaped cam is engaged with the clinch lever, the sector-shaped cam has a stepped portion formed on the periphery of the sector-shaped cam, and when the clinch lever is engaged with the stepped portion, a pressure with respect to the clincher link is reduced.

3. The paper-pressing table lock mechanism of a stapler according to claim 2, wherein the sector-shaped cam comprises a first and second sector-shaped cams, the first- and second sector-shaped cams have the same external feature, and the first and second sector-shaped cams are mounted on a common driving shaft so as to rotate at the same phase.

* * * * *